US010556149B2

(12) United States Patent
Aaron et al.

(10) Patent No.: US 10,556,149 B2
(45) Date of Patent: Feb. 11, 2020

(54) METHODS, SYSTEMS, AND PRODUCTS FOR MONITORING ATHLETIC PERFORMANCE

(71) Applicant: AT&T Intellectual Property I, L.P., Atlanta, GA (US)

(72) Inventors: Jeffrey A. Aaron, Atlanta, GA (US); John Ruckart, Atlanta, GA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 541 days.

(21) Appl. No.: 15/210,961

(22) Filed: Jul. 15, 2016

(65) Prior Publication Data

US 2016/0325142 A1 Nov. 10, 2016

Related U.S. Application Data

(63) Continuation of application No. 12/909,896, filed on Oct. 22, 2010, now Pat. No. 9,415,265, which is a continuation of application No. 11/699,095, filed on Jan. 29, 2007, now Pat. No. 7,841,966.

(51) Int. Cl.

| | |
|---|---|
| ***A63B 24/00*** | (2006.01) |
| ***A63B 69/00*** | (2006.01) |
| ***A63B 71/06*** | (2006.01) |

(52) U.S. Cl.

CPC ..... *A63B 24/0062* (2013.01); *A63B 24/0006* (2013.01); *A63B 69/0028* (2013.01); *A63B 2024/0009* (2013.01); *A63B 2024/0068* (2013.01); *A63B 2024/0071* (2013.01); *A63B 2071/0661* (2013.01); *A63B 2220/12* (2013.01); *A63B 2220/13* (2013.01); *A63B 2220/20* (2013.01); *A63B 2220/30* (2013.01); *A63B 2225/20* (2013.01); *A63B 2225/50* (2013.01); *A63B 2244/20* (2013.01)

(58) Field of Classification Search

None

See application file for complete search history.

(56) References Cited

U.S. PATENT DOCUMENTS

| | | | |
|---|---|---|---|
| 4,371,945 | A | 2/1983 | Karr et al. |
| 4,699,379 | A | 10/1987 | Chateau et al. |
| 5,065,414 | A | 11/1991 | Endou et al. |
| 6,013,007 | A | 1/2000 | Root |
| 6,032,108 | A | 2/2000 | Seiple |
| 6,122,959 | A | 9/2000 | Hoshal et al. |
| 6,135,951 | A | 10/2000 | Richardson et al. |
| 6,148,262 | A | 11/2000 | Fry |
| 6,302,789 | B2 | 10/2001 | Harada et al. |
| 6,473,483 | B2 | 10/2002 | Pyles |
| 6,493,652 | B1 | 12/2002 | Ohlenbusch et al. |
| 6,611,788 | B1 | 8/2003 | Hussa |
| 6,611,789 | B1 | 8/2003 | Darley |
| 6,669,600 | B2 | 12/2003 | Warmer |
| 6,705,972 | B1 | 3/2004 | Takano et al. |
| 6,736,759 | B1 | 5/2004 | Stubbs et al. |

(Continued)

*Primary Examiner* — Sundhara M Ganesan

(74) *Attorney, Agent, or Firm* — Hartman & Citrin LLC

(57) ABSTRACT

Methods, systems, and products monitor athletic performance. Location information is acquired that indicates a device is in movement. A level of difficulty associated with the location information is retrieved and associated to a distance traversed during the movement. The distance traversed and the level of difficulty are stored in a database.

15 Claims, 10 Drawing Sheets

(56) References Cited

U.S. PATENT DOCUMENTS

| | | | |
|---|---|---|---|
| 6,795,710 | B1 | 9/2004 | Creemer |
| 6,837,827 | B1 | 1/2005 | Lee et al. |
| 6,856,934 | B2 | 2/2005 | Vock |
| 6,876,947 | B1 | 4/2005 | Darley et al. |
| 6,882,955 | B1 | 4/2005 | Ohlenbusch et al. |
| 6,885,971 | B2 | 4/2005 | Vock et al. |
| 6,898,550 | B1 | 5/2005 | Blackadar et al. |
| 6,976,937 | B2 | 12/2005 | Chen |
| 7,016,812 | B2 | 3/2006 | Aritsuka et al. |
| 7,057,551 | B1 | 6/2006 | Vogt |
| 7,072,789 | B2 | 7/2006 | Vock et al. |
| 7,092,846 | B2 | 8/2006 | Vock et al. |
| 7,103,370 | B1 | 9/2006 | Creemer |
| 7,162,392 | B2 | 1/2007 | Vock et al. |
| 7,171,331 | B2 | 1/2007 | Vock et al. |
| 7,220,220 | B2 | 5/2007 | Stubbs et al. |
| 7,297,088 | B2 | 11/2007 | Tsuji |
| 7,353,137 | B2 | 4/2008 | Vock et al. |
| 7,400,259 | B2 | 7/2008 | O'Connor et al. |
| 7,433,805 | B2 | 10/2008 | Vock et al. |
| 7,451,056 | B2 | 11/2008 | Flentov et al. |
| 7,467,060 | B2 | 12/2008 | Kulach et al. |
| 7,506,460 | B2 | 3/2009 | DiBenedetto et al. |
| 7,536,190 | B1 | 5/2009 | Creemer |
| 8,142,197 | B2 | 3/2012 | Tucker |
| 2003/0065257 | A1 | 4/2003 | Mault |
| 2004/0116837 | A1 | 6/2004 | Yamaguchi et al. |
| 2004/0260191 | A1 | 12/2004 | Stubbs |
| 2005/0107216 | A1 | 5/2005 | Lee et al. |
| 2005/0119532 | A1 | 6/2005 | Cloutier |
| 2005/0130802 | A1 | 6/2005 | Kinnunen et al. |
| 2005/0245839 | A1 | 11/2005 | Stivoric et al. |
| 2005/0288154 | A1 | 12/2005 | Lee et al. |
| 2006/0009684 | A1 | 1/2006 | Kim |
| 2006/0020421 | A1 | 1/2006 | Darley et al. |
| 2006/0025282 | A1 | 2/2006 | Redmann |
| 2006/0098772 | A1 | 5/2006 | Reho et al. |
| 2006/0136173 | A1 | 6/2006 | Case |
| 2006/0183603 | A1 | 8/2006 | Astilean |
| 2006/0189360 | A1 | 8/2006 | White |
| 2006/0255955 | A1 | 11/2006 | O'Connor et al. |
| 2007/0021269 | A1 | 1/2007 | Shum |
| 2007/0100666 | A1* | 5/2007 | Stivoric ..... F24F 11/30 705/3 |
| 2007/0118328 | A1 | 5/2007 | Vock et al. |
| 2007/0149362 | A1 | 6/2007 | Lee et al. |
| 2007/0268108 | A1 | 11/2007 | Weinberg et al. |
| 2007/0275826 | A1 | 11/2007 | Niemimaki et al. |
| 2008/0096727 | A1 | 4/2008 | Lee et al. |
| 2008/0172204 | A1 | 7/2008 | Nagashima et al. |
| 2009/0005220 | A1 | 1/2009 | Lee et al. |
| 2009/0197619 | A1 | 8/2009 | Colligan et al. |
| 2009/0275347 | A1 | 11/2009 | Creemer |

* cited by examiner

METHODS, SYSTEMS, AND PRODUCTS FOR MONITORING ATHLETIC PERFORMANCE

CROSS-REFERENCE TO RELATED APPLICATIONS

This application is a continuation of U.S. patent application Ser. No. 12/909,896 filed Oct. 22, 2010 and since issued as U.S. Pat. No. 9,415,265, which is continuation of U.S. patent application Ser. No. 11/699,095 filed Jan. 29, 2007 and since issued as U.S. Pat. No. 7,841,966, with both applications incorporated herein by reference in their entireties.

BACKGROUND

The exemplary embodiments generally relate to communications, to exercise devices, and to data processing and, more particularly, to navigation and to monitoring exercise parameters.

Exercise is essential to a healthy lifestyle. Experts recommend daily physical activity to reduce stress, improve the cardiovascular system, and even improve mental health. Physicians thus recommend that each person undertake a minimum amount of aerobic exercise. Performance goals may be established for this aerobic exercise, such as running ten miles per week, walking 250 miles per year, or swimming one mile each day. Whatever the performance goal, measurement is essential to achieving the goal. If a person does not measure progress towards the performance goals, then that person will never know if their physical activity meets the recommendations for a healthy lifestyle. What is needed, then, are methods, systems, and products for monitoring athletic performance that help athletes achieve their performance goals.

SUMMARY

The exemplary embodiments provide methods, systems, and products for monitoring athletic performance. As an athlete walks, jogs, or swims, exemplary embodiments track or monitor the time, speed/pace, and distance covered by the athlete. Exemplary embodiments describe a device that the user carries or wears while exercising. The device uses any location system (such as a Global Positioning System) to measure or obtain the user's performance data (e.g., position, speed, distance, time, and/or direction). The performance data is then compared to performance targets or goals, and exemplary embodiments may make recommendations to meet the performance goals. If, for example, the user has a goal of walking three miles per day, exemplary embodiments track and measure movement of the device. Exemplary embodiments compare the distance traversed by the device and compare that distance to the three-mile goal. If the user falls short of the goal, the device may visually or audibly notify the user and make recommendations to meet the goal.

Exemplary embodiments, however, distinguish acceptable movement from transportation. Because the user carries the device, exemplary embodiments may be incorporated into any wireless phone, radio, or music player. Whatever the device, exemplary embodiments may differentiate walking, jogging, and other athletic performance from transportation. That is, if the user is riding in a car or plane, the device's speed and distance traversed could greatly impact any comparison to the performance goals. Suppose, for example, that the user has a goal of walking five miles per week, and the user's wireless phone tracks distances and tallies movements toward the goal. Yet the user would not want the phone tallying miles traversed while riding in a car. The phone is moving, but that movement is not exercise. Exemplary embodiments, then, differentiate movement during athletic performance from movement during transportation. When the movement indicates transportation, then that movement may be excluded and not accumulated as athletic performance.

Exemplary embodiments include a method for monitoring athletic performance. Information is acquired that indicates a device is in movement. The movement is differentiated from transportation. When the movement indicates transportation, then the movement is excluded as unrelated to the athletic performance.

More exemplary embodiments include a system for monitoring athletic performance. A processor communicates with memory, and the memory stores instructions for acquiring information that indicates a device is in movement. The movement is differentiated from transportation. When the movement indicates transportation, then the movement is excluded as unrelated to the athletic performance.

Other exemplary embodiments describe a computer program product for monitoring athletic performance. The computer program product stores instructions for acquiring information that indicates a device is in movement. The movement is differentiated from transportation. When the movement indicates transportation, then the movement is excluded as unrelated to the athletic performance.

Other systems, methods, and/or computer program products according to the exemplary embodiments will be or become apparent to one with ordinary skill in the art upon review of the following drawings and detailed description. It is intended that all such additional systems, methods, and/or computer program products be included within this description, be within the scope of the claims, and be protected by the accompanying claims.

BRIEF DESCRIPTION OF THE SEVERAL VIEWS OF THE DRAWINGS

These and other features, aspects, and advantages of the exemplary embodiments are better understood when the following Detailed Description is read with reference to the accompanying drawings, wherein.

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. The functions of the various elements shown in the figures may be provided through the use of dedicated hardware as well as hardware capable of executing associated software. Those of ordinary skill in the art further understand that the exemplary hardware, software, processes, methods, and/or operating systems described herein are for illustrative purposes and, thus, are not intended to be limited to any particular named manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will also be understood that, although the terms first, second, etc., may be used herein to describe various elements, these elements should not be limited by these terms. These terms are only used to distinguish one element from another. For example, a first device could be termed a second device, and, similarly, a second device could be termed a first device without departing from the teachings of the disclosure.

Figure 1:
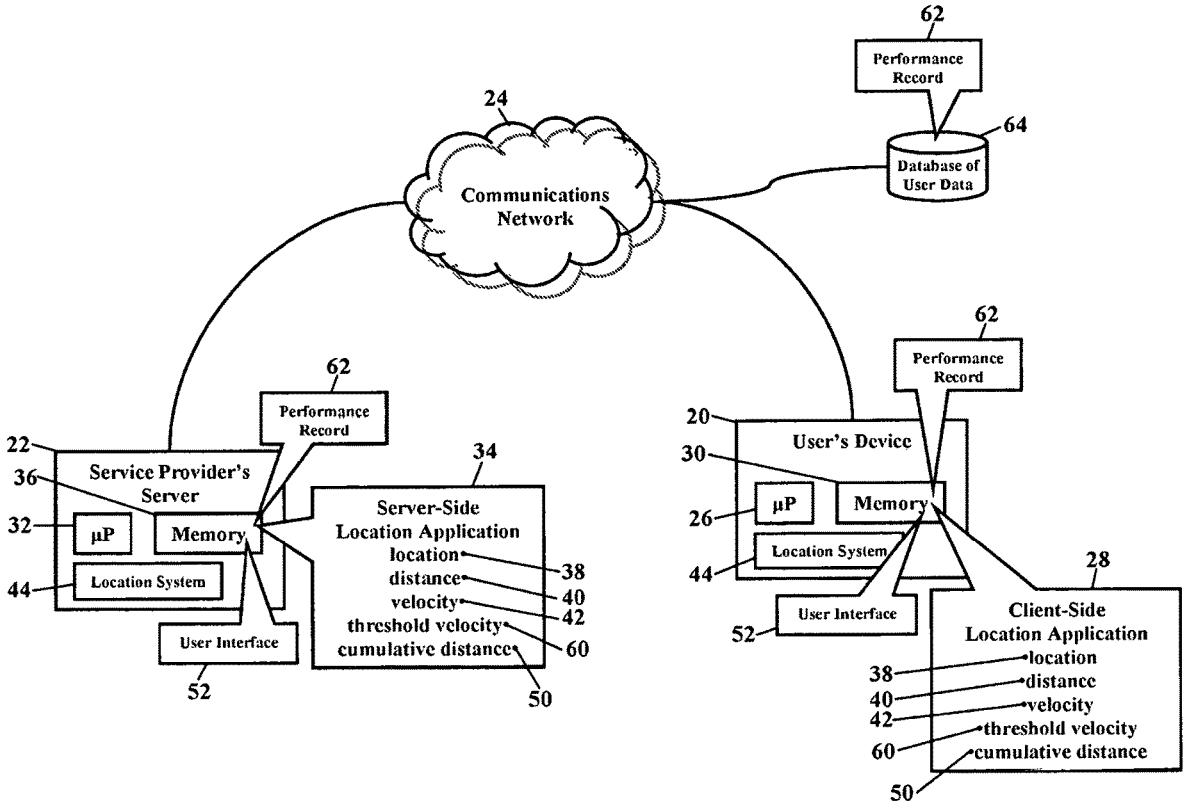
FIG. 1 is a schematic illustrating an environment in which exemplary embodiments may be implemented.

FIG. 1 is a schematic illustrating an environment in which exemplary embodiments may be implemented. A user's device 20 communicates with a service provider's server 22 via a communications network 24. Although the user's device 20 is generically shown, the device 20, as will be later explained, may be a computer, a radio, a personal digital assistant (PDA), a cordless/cellular/IP phone, digital music player, or any other processor-controlled device. According to exemplary embodiments, whatever the user's device 20, the user's device 20 has a processor 26 (e.g., "μP"), application specific integrated circuit (ASIC), or other similar device that executes a client-side location application 28 stored in memory 30. The service provider's server 22 includes a processor 32 that executes a complementary server-side location application 34 stored in memory 36. The client-side location application 28 and the complementary server-side location application 34 are processor-executable instructions that cooperate to monitor or track the location coordinates 38, distance 40, and velocity 42 of the user's device 20. That is, as the user carries the device 20, a location system 44 determines or monitors the distance 40 traversed by the user's device 20. The location system 44 may also monitor or compute the velocity 42 as the distance 40 is traversed. The location system 44 may utilize triangulation and/or global positioning system information. While the location system 44 is shown residing or operating in both the user's device 20 and in the service provider's server 22, the location system 44 may only operate within either system. Moreover, the location system 44 may alternatively or additionally be a service provided by a separate server and accessible via the communications network 24. Because, however, location systems are well known to those of ordinary skill in the art, no further discussion is made.

A cumulative distance 50 may be stored. According to exemplary embodiments, the cumulative distance 50 tallies the total distance traversed by the user's device 20 in a period of time. As the user's device 20 moves, the distance 40 traversed may be added to the cumulative distance 50. The cumulative distance 50, for example, may tally the distance 40 the user walks/runs in an hour, a day, a week, a month, or any other interval of time. The user may utilize a user interface 52 to configure the client-side location application 28 and/or the server-side location application 34 and specify the desired interval of time in which the cumulative distance 50 is maintained. Exemplary embodiments thus help the user track daily, weekly, monthly, and/or yearly walking/jogging/swimming goals. The user may configure the cumulative distance 50 to continuously track distances for even longer term goals. However the cumulative distance 50 is configured, the cumulative distance 50 allows the user to monitor progress towards the performance goal.

Exemplary embodiments, however, differentiate walking and jogging from transportation. As the user's device 20 moves, the distance 40 traversed may be added to the cumulative distance 50. If the user is riding in a car or plane, however, the user would not want that distance to be added to the cumulative distance 50. Exemplary embodiments, then, differentiate distances traversed while walking or jogging from those distances traversed by car, train, bus, plane, or any other mode of transportation. As FIG. 1 illustrates, exemplary embodiments may compare the velocity 42 to a threshold velocity value 60. The threshold velocity value 60 is a configurable parameter that the user selects as a maximum velocity at which the corresponding distance is added to the cumulative distance 50. When the location system 44 monitors or computes the distance 40 and the velocity 42, exemplary embodiments ignore any distance traversed at too great a velocity. The client-side location application 28 and/or the server-side location application 34 may compare the velocity 42 to the threshold velocity value 60. When the velocity 42 exceeds the threshold velocity value 60, then the distance 40 may be excluded from the cumulative distance 50 associated with the user's device 20. When the velocity 42 is less than or equal to the threshold velocity value 60, then the distance 40 may be added to the cumulative distance 50. Exemplary embodiments may thus use the velocity 42 as a differentiator between exercise and transportation.

FIG. 1 also illustrates a performance record 62. The performance record 62 stores a performance history for the user. The user may thus access the performance record and obtain archival short-term or long-term performance data. While the user's performance record 62 may be locally stored in the memory 30 of the user's device 20, the user's performance record 62 may also be stored in a centralized database 64 of user data. The database 64 of user data is a repository that stores a profile for each user, and each user's profile contains their performance record 62. While the database 64 of user data is illustrated as being remotely accessible via the communications network 24, the database 64 of user data may be stored in the memory 30 of the user's device 20 or stored in the memory 36 of the service provider's server 22. The user may access the user's performance record 62 and obtain current and/or historical distances, speed/pace, routes traversed, times, and any other stored performance parameter.

Exemplary embodiments are completely configurable. The user, or the service provider, may configure the client-side location application 28 and/or the server-side location application 34 as desired to best suit any criteria or goal. The user, for example, may wish to carry a music player and have it constantly accumulate distances walked or jogged. The user may thus configure the client-side location application 28 and/or the server-side location application 34 to automatically and constantly differentiate exercise from transportation without manual start/stop instructions or commands. The service provider, too, may configure the client-side location application 28 and/or the server-side location application 34 to auto-execute, thus providing a constant service that operates in the background and does not greatly impair or impede other services or features available to the user.

The user's device 20 is only simply illustrated. The user's device 20 may be any processor-controlled device. The user's device 20, for example, may be a personal digital assistant (PDA), any Global Positioning System (GPS) device, an Internet Protocol (IP) phone, a pager, a cellular/satellite phone, a digital music player, computer, a watch, a radio, or a television. Because the architecture and operating principles of these devices are well known, the hardware and software componentry of the user's device 20 is not further shown and described.

The service provider's server 22 is also simply illustrated. Because its architecture and operating principles are well known, its hardware and software components are not further shown and described. If the reader desires more details, the reader is invited to consult the following sources, all incorporated herein by reference in their entirety: Andrew Tanenbaum, Computer Networks (4th edition 2003); William Stallings, Computer Organization and Architecture: Designing for Performance (7th 2005); and David A. Patterson & John L. Hennessy, Computer Organization and Design: The Hardware/Software Interface (3rd. Edition 2004).

Exemplary embodiments may be applied regardless of networking environment. The communications network 24 may be a cable network operating in the radio-frequency domain and/or the Internet Protocol (IP) domain. The communications network 24, however, may also include a distributed computing network, such as the Internet (sometimes alternatively known as the "World Wide Web"), an intranet, a local-area network (LAN), and/or a wide-area network (WAN). The communications network 24 may include coaxial cables, copper wires, fiber optic lines, and/or hybrid-coaxial lines. The communications network 24 may even include wireless portions utilizing any portion of the electromagnetic spectrum and any signaling standard (such as the I.E.E.E. 802 family of standards, GSM/CDMA/TDMA or any cellular standard, and/or the ISM band). The concepts described herein may be applied to any wireless/wireline communications network, regardless of physical componentry, physical configuration, or communications standard(s).

Some aspects of performance monitors are known, so this disclosure will not greatly explain the known details. If the reader desires more details, the reader is invited to consult the following sources, all incorporated herein by reference in their entirety: U.S. Pat. No. 6,013,007 to Root et al. (Jan. 11, 2000); U.S. Pat. No. 6,032,108 to Seiple et al. (Feb. 29, 2000); U.S. Pat. No. 6,148,262 to Fry (Nov. 14, 2000); U.S. Pat. No. 6,611,788 to Hussa (Aug. 26, 2003); U.S. Pat. No. 6,856,934 to Vock et al. (Feb. 15, 2005); U.S. Pat. No. 7,057,551 to Vogt (Jun. 6, 2006); U.S. Patent Application Publication 2003/0065257 to Mault et al. (Apr. 3, 2003); U.S. Patent Application Publication 2004/0260191 to Stubbs et al. (Dec. 23, 2004); U.S. Patent Application Publication 2006/0009684 to Kim (Jan. 12, 2006); U.S. Patent Application Publication 2006/0025282 to Redmann (Feb. 2, 2006); U.S. Patent Application Publication 2006/0136173 to Case et al. (Jun. 22, 2006); U.S. Patent Application Publication 2006/0183603 to Astilean (Aug. 17, 2006); and U.S. Patent Application Publication 2006/0189360 to White (Aug. 24, 2006).

Figure 2:
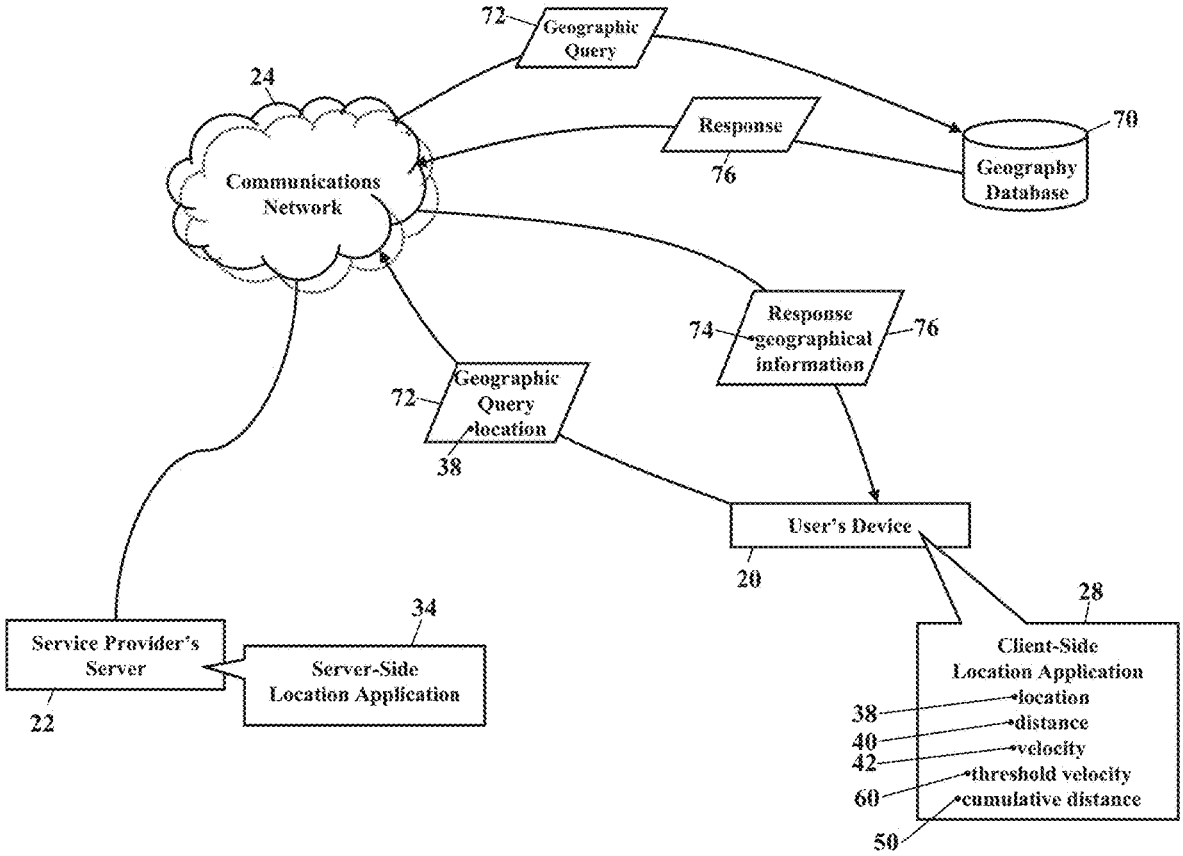
FIG. 2 is a schematic illustrating a geography database, according to more exemplary embodiments.

FIG. 2 is a schematic illustrating a geography database 70, according to more exemplary embodiments. The geography database 70 stores or maintains information that describes geographical features associated with a location. The geography database 70 is illustrated as being remotely accessible via the communications network 24, yet the geography database 70 may be locally stored in the user's device 20 or locally stored in the service provider's server 22. The geography database 70 maps, relates, or otherwise associates geographical information to the location coordinates 38. The geography database 70 is queried for a geography associated with the location coordinates 38. FIG. 2 illustrates a geographic query 72 originating from the user's device 20, yet the geographic query 72 may originate from the service provider's server 22. Regardless, the geographic query 72 communicates via the communications network 24 to a network address associated with the geography database 70. The geography database 70 retrieves geographical information 74 associated with the location coordinates 38. The geography database 70 then sends a query response 76 that includes the geographical information 74.

The geography database 70 stores the geographical information 74. The geographical information 74 may describe any terrain or topology associated with the location coordinates 38. The geographical information 74 may describe any features due to the distribution of animals and/or humans. The geographical information 74 may precisely describe any physical features associated with the location coordinates 38, such as hills, plains, mountains, or flatlands. The geographical information 74 may include information describing lakes, rivers, streams, and other water passages that may be used for exercise (e.g., swimming, rowing, canoeing). The geographical information 74 may include information describing sidewalks, trails, paths, tracks, gyms, or other features and places that may be used as jogging/walking routes. The geographical information 74 thus describes any features associated with the location coordinates 38.

Figure 3:
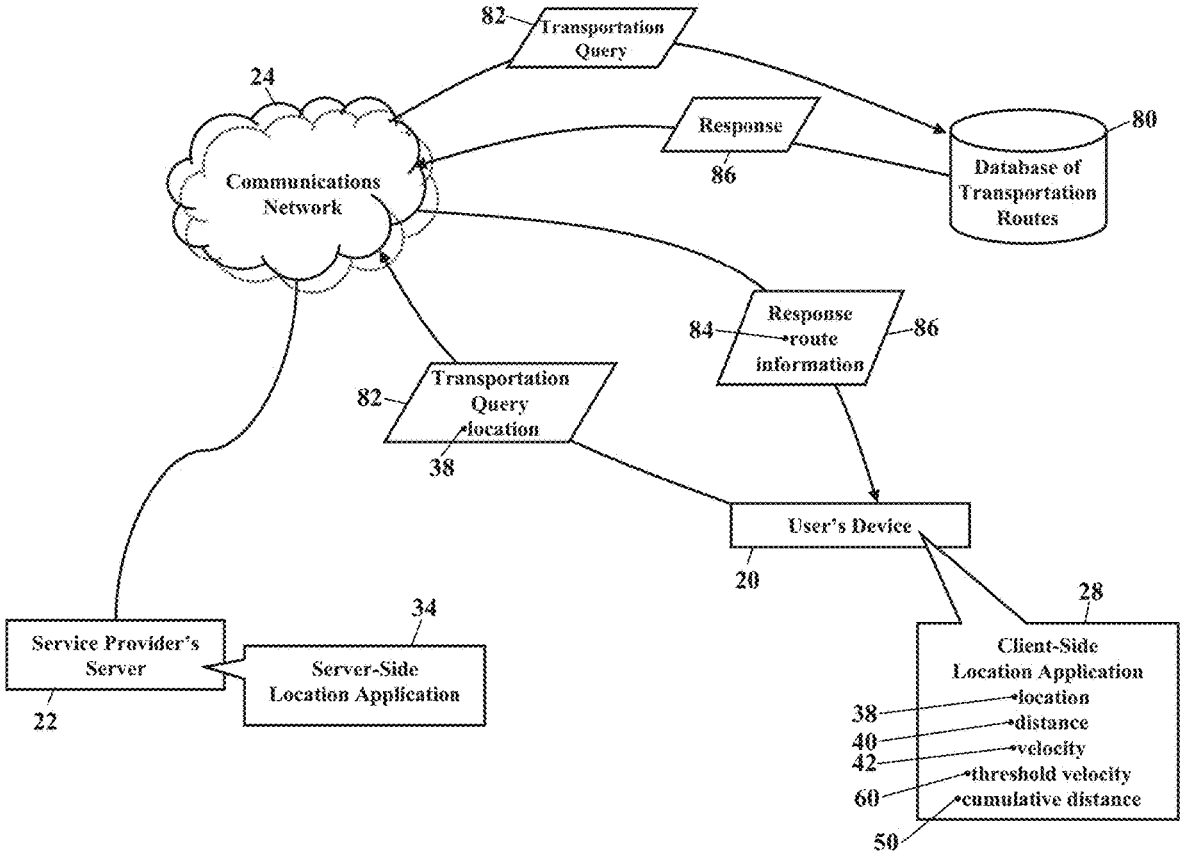
FIG. 3 is a schematic illustrating a database of transportation routes, according to more exemplary embodiments.

FIG. 3 is a schematic illustrating a database 80 of transportation routes, according to more exemplary embodiments. The database 80 of transportation routes stores information describing public/private roads, highways, and any other vehicle passageways. The database 80 of transportation routes is illustrated as being remotely accessible via the communications network 24, yet the database 80 of transportation routes may be locally stored in user's device 20 or in the service provider's server 22. Regardless, the database 80 of transportation routes maps, relates, or otherwise associates vehicle passageways to the location coordinates 38. The database 80 of transportation routes, for example, may be queried for roads associated with the location coordinates 38. FIG. 3 illustrates a transportation query 82 originating from the user's device 20, yet the transportation query 82 may originate from the service provider's server 22. Regardless, the transportation query 82 communicates via the communications network 24 to a network address associated with the database 80 of transportation routes. The database 80 of transportation routes retrieves transportation route information 84 associated with the location coordinates 38. The database 80 of transportation routes then sends a query response 86 that includes the route information 84.

Exemplary embodiments thus differentiate walking, jogging, or even swimming from transportation. When exemplary embodiments compare the velocity 42 to the threshold velocity value 60, the client-side location application 28 and/or the server-side location application 34 may also query the database 80 of transportation routes. Even though the velocity 42 may be less than the threshold velocity value 60, exemplary embodiments may also query the database 80 of transportation routes to determine if the location coordinates 38 coincide with a public or private roadway. When the distance traversed coincides with a transportation route, the low-speed movement of the user's device 20 may be due to a traffic jam or some other low-speed transportation. If the user is creeping along a congested freeway, for example, the device's low-speed movement could be mistaken for walking or jogging. Exemplary embodiments, however, may exclude the distance 40 from the cumulative distance 50 when the location coordinates 38 indicate a road is being traversed. The database 80 of transportation routes thus further helps differentiate walking or jogging from transportation.

Figure 4:
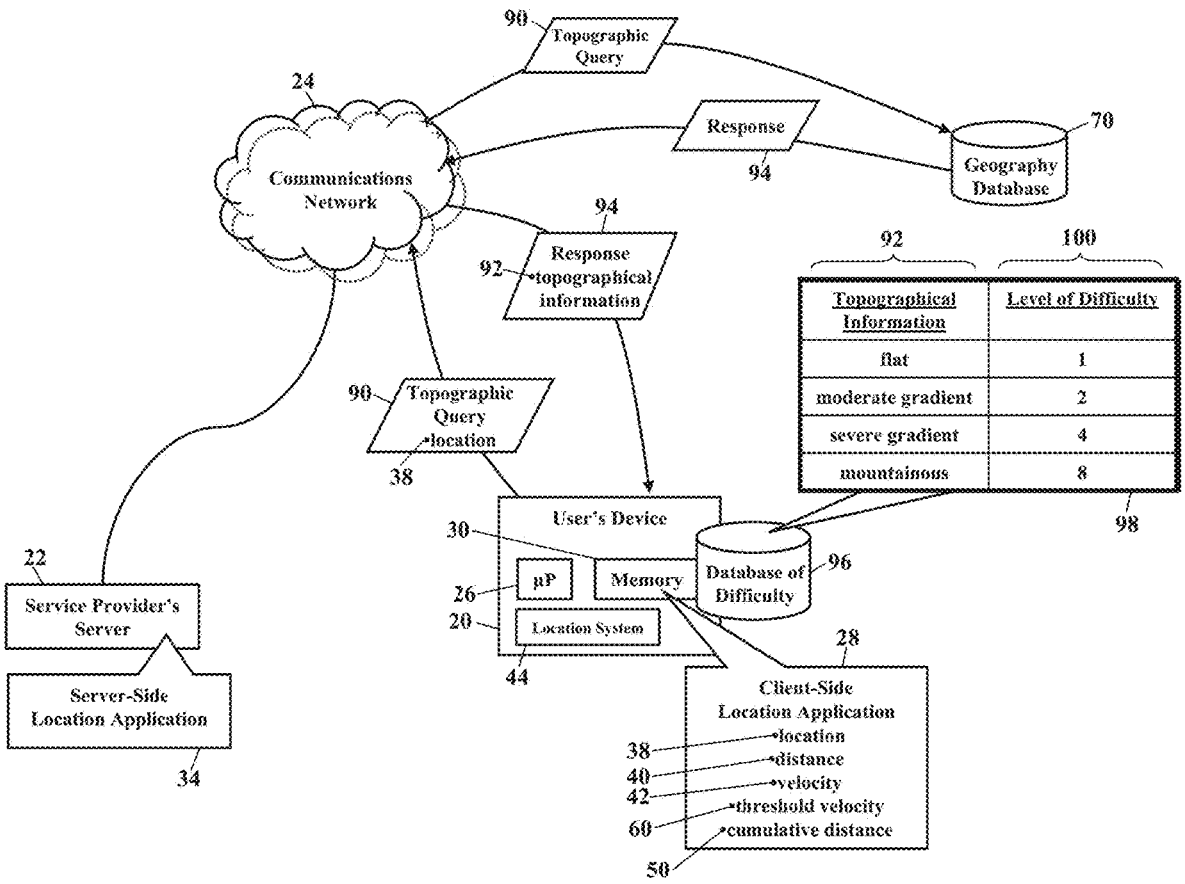
FIG. 4 is a schematic illustrating levels of difficulty, according to exemplary embodiments.

FIG. 4 is a schematic illustrating levels of difficulty, according to exemplary embodiments. Here, as the user carries the device 20, exemplary embodiments determine a level of difficulty for the distance 40 traversed. When the client-side location application 28 and/or the complementary server-side location application 34 receives the location coordinates 38, the geography database 70 is queried for the topography associated with the location coordinates 38. Exemplary embodiments then infer a level of difficulty from the topography. As FIG. 4 illustrates, a topographic query 90 is sent to the geography database 70. FIG. 4 illustrates the topographic query 90 originating from the user's device 20, yet the topographic query 90 may originate from the service provider's server 22. Regardless, the geography database 70 retrieves topographical information 92 associated with the location coordinates 38 and sends a query response 94. Here the query response 94 includes the topographical information 92 describing the geography or topography of the distance 40 being traversed by the user's device 20.

A database 96 of difficulty may then be queried. The database 96 of difficulty maps, relates, or otherwise associates a level of difficulty to the topographical information 92. While the database 96 of difficulty is illustrated as being locally stored in the user's device 20, the database 96 of difficulty may be stored in the service provider's server 22 or may be remotely accessible via the communications network 24. The database 96 of difficulty, for example, may store a table 98 that relates the topographical information 92 to a level 100 of difficulty. The database 96 of difficulty may store fine distinctions in topology that are related to many levels of difficulty. The database 96 of difficulty may alternatively store broad categories of topology that are related to only a few levels of difficulty. Regardless, the database 96 of difficulty retrieves the level 100 of difficulty associated with the topographical information 92. The database 96 of difficulty then responds to the query and returns the level 100 of difficulty associated with the topographical information 92. The client-side location application 28 and/or the complementary server-side location application 34 receives the level 100 of difficulty and associates that level 100 of difficulty to the distance 40.

Figure 5:
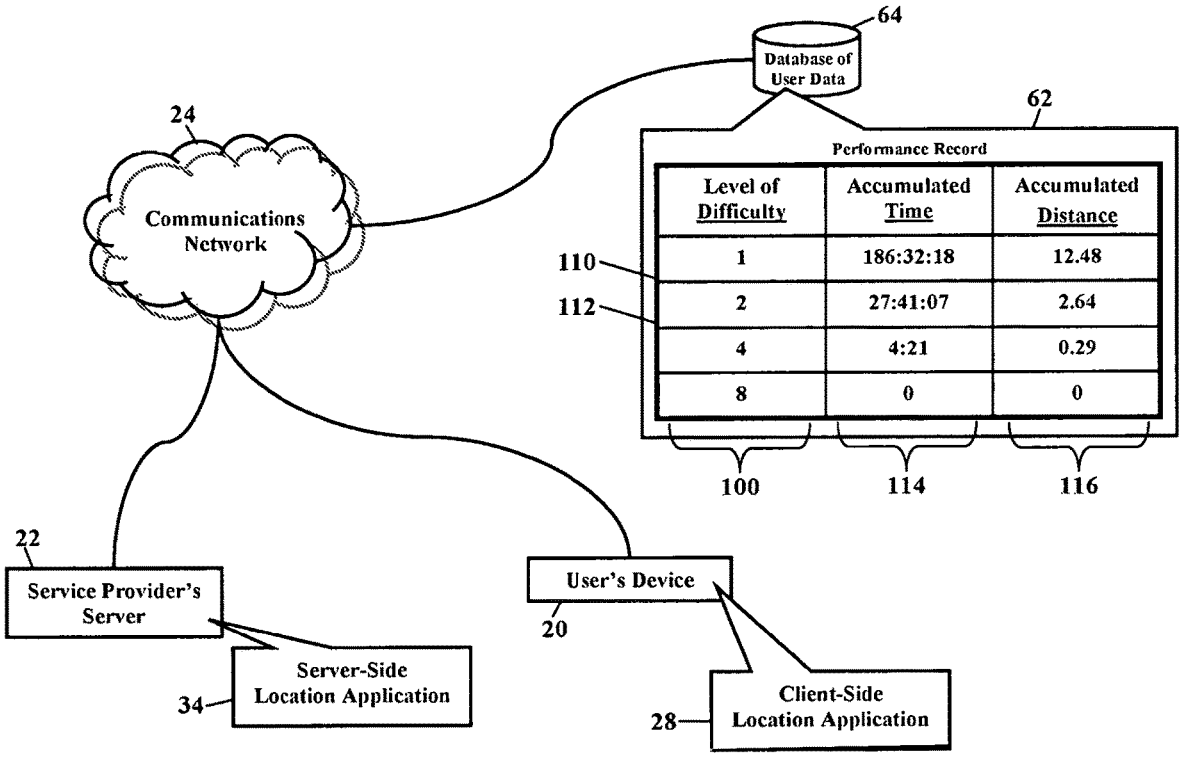
FIG. 5 is a schematic illustrating a performance matrix, according to exemplary embodiments.

FIG. 5 is a schematic illustrating a performance matrix 110, according to exemplary embodiments. The performance matrix 110 tracks the cumulative time and/or distance at each level of difficulty. Although the performance matrix 110 is illustrated as being remotely stored in the database 64 of user data, the performance matrix 110 may alternatively be stored in the user's device 20 or in the service provider's server 22. The performance matrix 110 is illustrated as a table 112 that tracks a time 114 and a distance 116 accumulated at each level 100 of difficulty. That is, as the user walks, jogs, or even swims, the performance matrix 110 accumulates the time 114 spent traversing distances 116 having the corresponding level 100 of difficulty. The user may thus access the performance matrix 110 and know how much time was spent, and how much distance was traversed, at low levels of difficulty verses higher/harder levels of difficulty.

Figure 6:
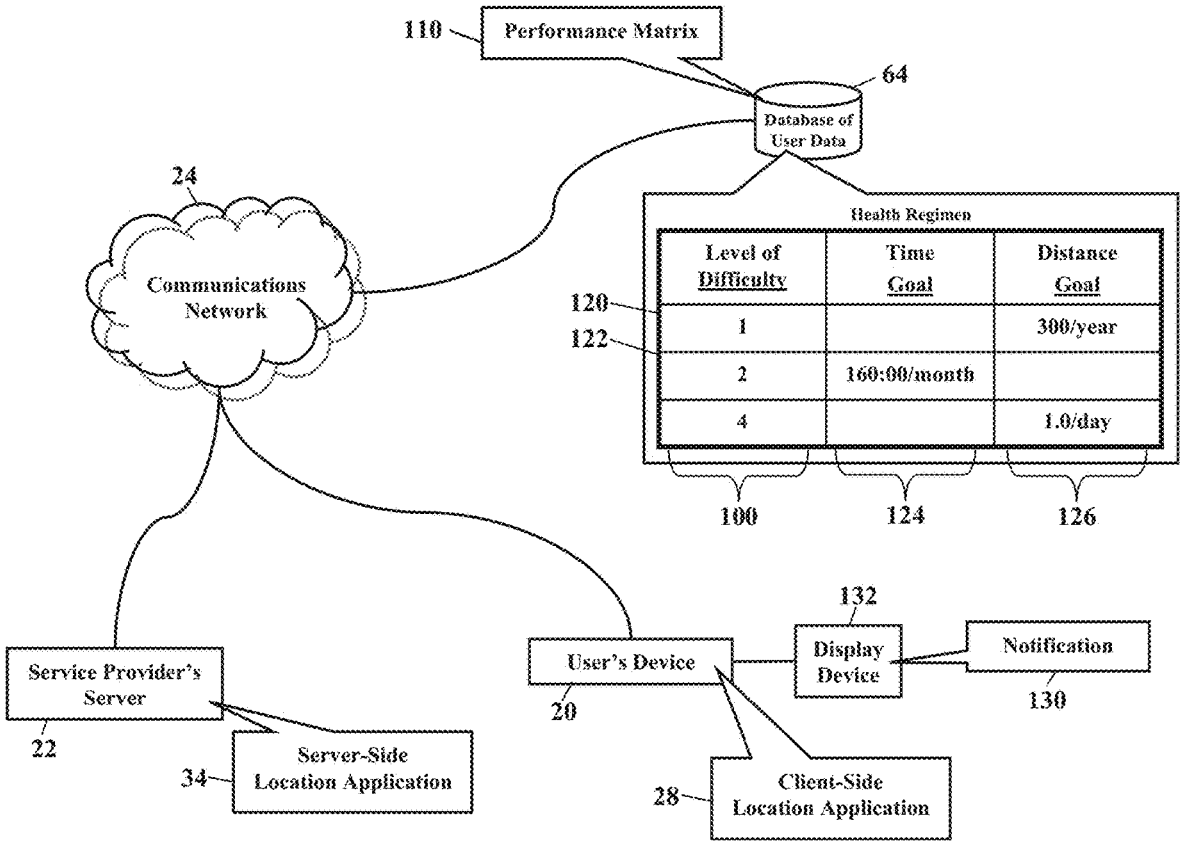
FIG. 6 is a schematic illustrating health recommendations, according to exemplary embodiments.

FIG. 6 is a schematic illustrating health recommendations, according to exemplary embodiments. Here exemplary embodiments may compare the user's performance data to a health regimen 120 and make recommendations for improvement. While the health regimen 120 is preferably stored in the database 64 of user data, the health regimen 120 may alternatively be stored in the user's device 20 or in the service provider's server 22. The health regimen 120 contains any quantitative parameters that may be compared or related to the location, distance, velocity, and/or time associated with the user's device 20. FIG. 6, for example, illustrates the health regimen 120 as a table 122 that specifies time goals 124 and/or distance goals 126 for the levels 100 of difficulty. The health regimen 120, for example, may specify a yearly goal of walking 300 miles at a low level of difficulty, a monthly goal of jogging 160 minutes at a moderate level of difficulty, and a daily goal of walking one (1) mile at a high level of difficulty. Whatever the health regimen 120, the client-side location application 28 and/or the complementary server-side location application 34 may retrieve the data in the performance matrix 110, retrieve the data in the health regimen 120, and then make a comparison. That is, the health regimen's time goals 124 and/or distance goals 126 are compared to the performance matrix's accumulated time and distance at each level of difficulty (shown, respectively, as reference numerals 110, 114, 116, and 100 in FIG. 5). The client-side location application 28 and/or the server-side location application 34 may then send or produce a notification 130 that informs users of their progress towards the performance goals. FIG. 6, for example, illustrates the client-side location application 28 visually presenting the notification 130 on a display device 132 communicating with the user's device 20. The notification 130 alerts of the user's progress toward matching the time goals 124 and/or distance goals 126 for the levels 100 of difficulty.

Figure 7:
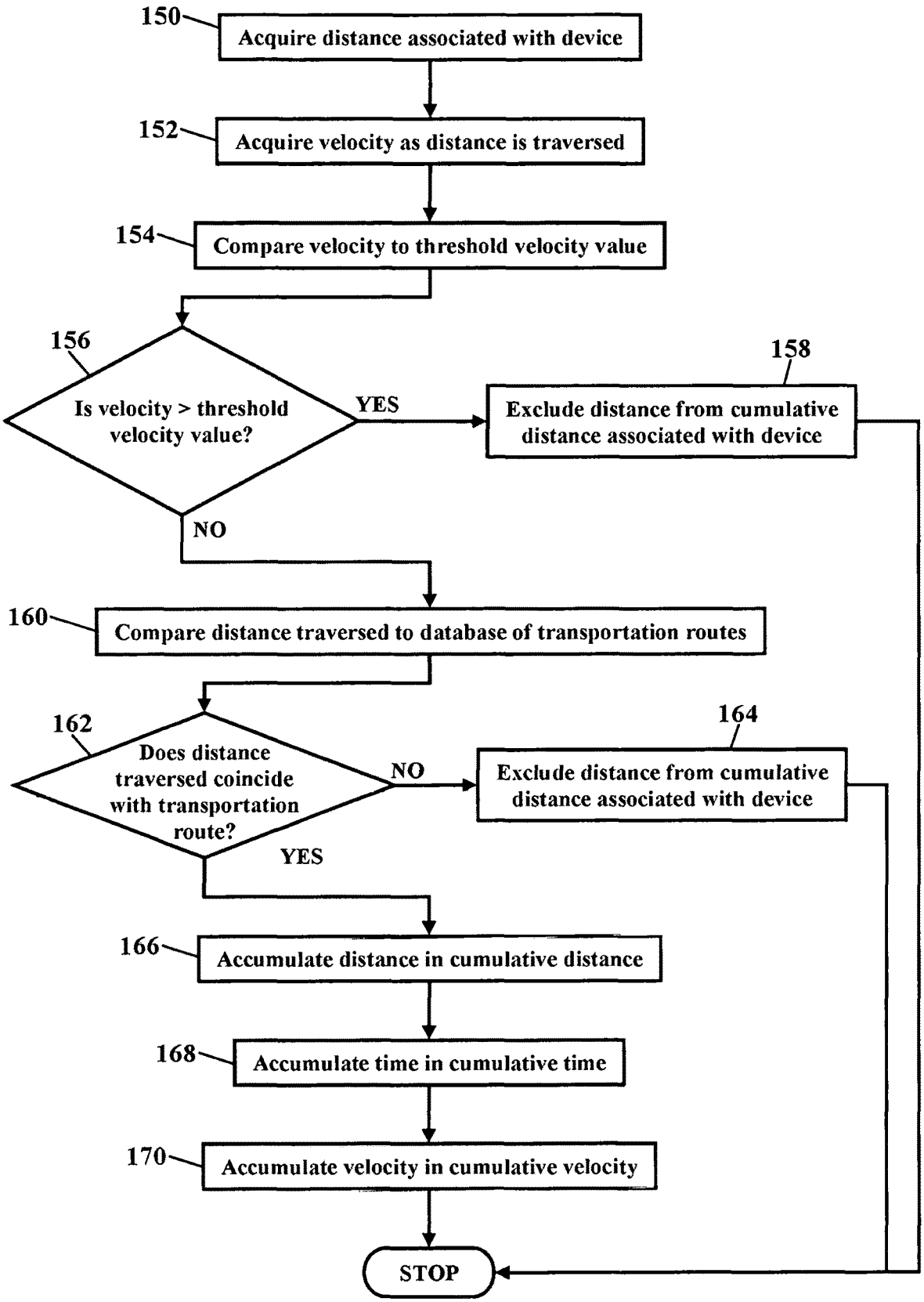
FIG. 7 is a flowchart illustrating a method of monitoring athletic performance, according to exemplary embodiments.

FIG. 7 is a flowchart illustrating a method of monitoring athletic performance, according to exemplary embodiments. A distance associated with a device is acquired (Block 150). A velocity as the distance is traversed is also acquired (Block 152). The velocity is compared to a threshold velocity value (Block 154). If the velocity exceeds the threshold velocity value (Block 156), then the distance is excluded from a cumulative distance associated with the device (Block 158). If, however, the velocity is less than or equal to the threshold velocity value (Block 156), then the distance traversed is compared to a database of transportation routes (Block 160). If the distance traversed coincides with a road or other transportation route (Block 162), then the distance is excluded from the cumulative distance (Block 164). Otherwise, when the velocity is less than the threshold velocity value (Block 156), and when the distance traversed does not coincide with a public road (Block 162), then the distance is accumulated in the cumulative distance (Block 166). The time (Block 168) and velocity (Block 170) associated with the distance traversed may also be accumulated.

Figure 8:
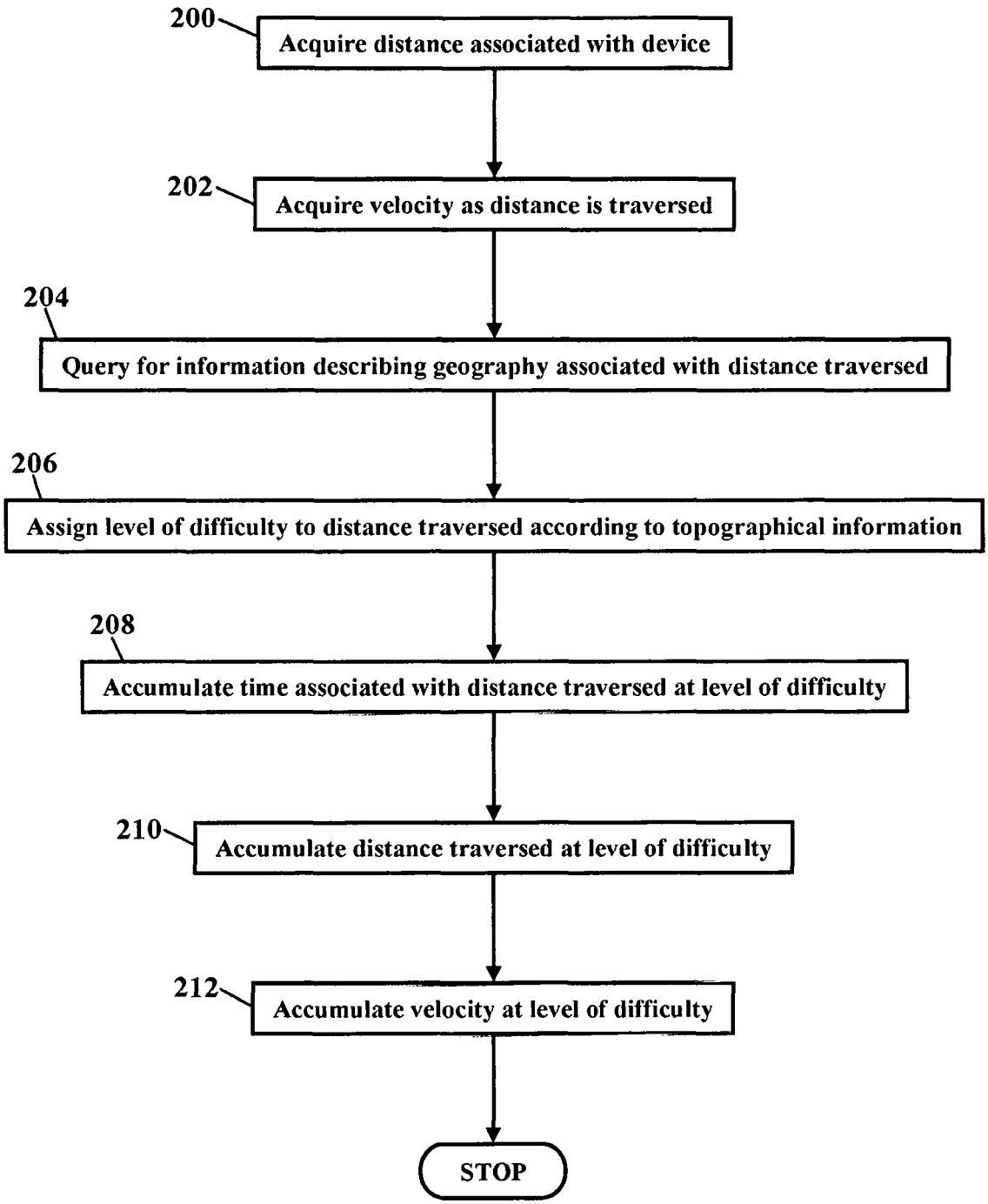
FIG. 8 is a flowchart illustrating another method of monitoring athletic performance, according to more exemplary embodiments.

FIG. 8 is a flowchart illustrating another method of monitoring athletic performance, according to more exemplary embodiments. A distance traversed (Block 200) and a velocity (202) associated with a device are acquired. A query is made for information describing a geography associated with the distance traversed (Block 204). A level of difficulty is assigned to the distance traversed according to topographical information (Block 206). A time associated with the distance traversed at the level of difficulty is accumulated (Block 208). The distance traversed (Block 210) and the velocity (212) at the level of difficulty may be accumulated.

Figure 9:
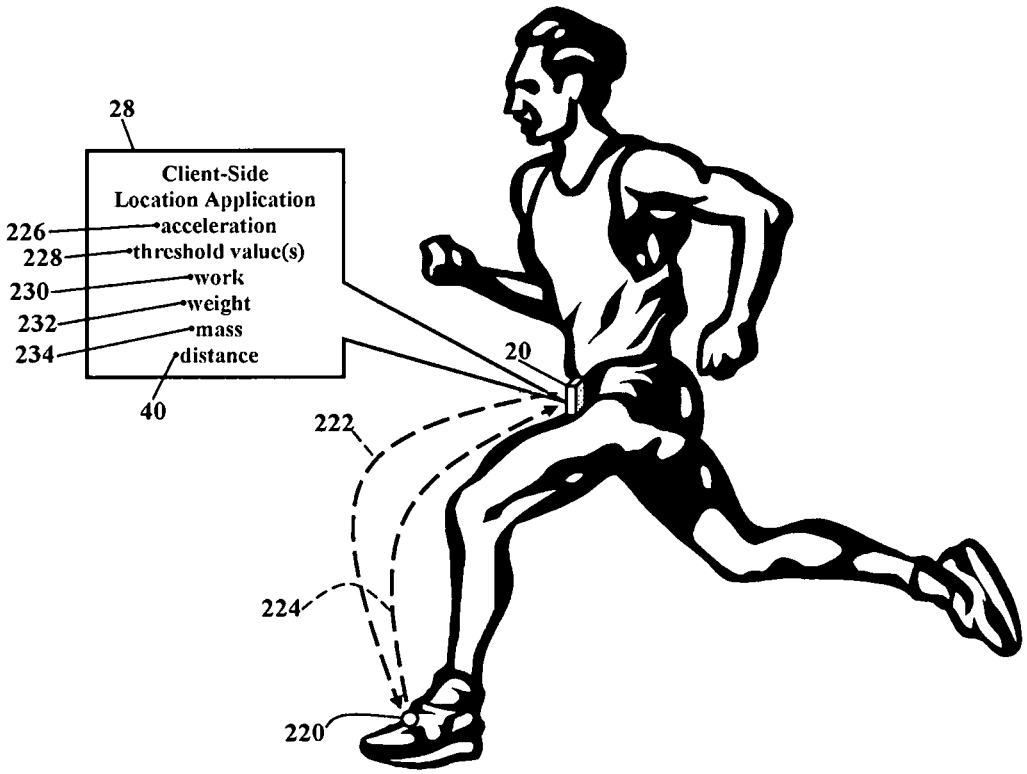
FIG. 9 is a schematic illustrating another environment in which exemplary embodiments may be implemented.

FIG. 9 is a schematic illustrating another environment in which exemplary embodiments may be implemented. Here the user is illustrated as a jogger, and the user's device 20 is worn or attached around the user's waist. The user's device 20, for example, may be a wireless phone or digital music device. The user's device 20 wirelessly communicates with a transponder 220. The transponder 220 is illustrated as being attached to one of the user's shoes, but the transponder 220 may additionally or alternatively be attached to the user's legs or arms. The user's device 20 emits an electromagnetic field or wave 222, and the transponder 220 responds with a return signal 224. The client-side location application 28 analyzes the return signal 224 to differentiate athletic movement from transportation. The user's device 20 thus couples (inductively or propagatively) with the transponder 220 and determines whether the user is exercising or riding in a car. The transponder 220 is any transmitter or responder (hence the term "transponder") that responds to the emitted electromagnetic field or wave 222. The transponder 220, for example, may be a passive or active "tag" that is fabricated using integrated circuits, coils, or "coil-on-chip" technology. The transponder 220 may respond using the ISM band (e.g., "Bluetooth") or the RF band, but the transponder 220 may utilize any frequency in the electromagnetic spectrum. Transponders, however, are well-known to those of ordinary skill in the art, so the intricate details of transponder componentry and/or circuitry are not repeated here.

Exemplary embodiments analyze the return signal 224. Any characteristic of the return signal 224 may be used to differentiate athletic movement from transportation. The return signal 224, for example, may represent an acceleration 226 of the transponder 220. Whenever the acceleration 226 of the transponder 220 indicates that the user's arms or legs are moving, then the distance traversed during that acceleration 226 may be accumulated. An experienced athlete, however, may have a constant stride or motion, which may not yield an acceptable acceleration. Yet the transponder 220 would detect acceleration changes at the extension of the runner's stride, so those changes may indicate athletic movement.

Exemplary embodiments may make comparisons. When the return signal 224 represents the acceleration 226 of the transponder 220, that acceleration 226 may be compared to one or more threshold values 228. When the acceleration 226 fails to satisfy the threshold value(s) 228, then the movement may be transportation and excluded as unrelated to the athletic performance. The threshold value 228, for example, may represent a maximum acceleration at which any activity is considered athletic performance. If the acceleration 226 is greater than the threshold value 228, then the corresponding movement may be unrelated to athletic performance. Conversely, when the threshold value 228 represents a minimum acceleration, then any acceleration less than the threshold value 228 may also be unrelated to athletic performance. The user may thus configure the one or more threshold values 228 to establish ranges of acceleration that are acceptable as related to athletic performance. Any acceleration outside those ranges may be unrelated to athletic performance.

Exemplary embodiments may compute measurements of work 230. Exemplary embodiments may determine an amount of work 230 expended during the movement. The work done by a force F during the movement from position $x_1$ to position $x_2$ may be expressed as $$\text{Work} = {}_{x_1}^{x_2} F dx.$$

See Sears, Zemansky & Young, University Physics 259 (1980). Because the acceleration a (illustrated as reference numeral 226) is known from the return signal 224, the force F may be calculated from a known mass (using F=ma). Exemplary embodiments may use a mass of an accelerometer in the transponder 220. Exemplary embodiments may use a mass of the user's shoe to which the transponder 220 is attached. Exemplary embodiments, however, may use the body mass of the user. Because the user's body is likely moving with the same acceleration 226 as the transponder 220, the acceleration 226 (known from the return signal 224) may be combined or multiplied with the mass of the user's body. The client-side location application 28, for example, may prompt the user to enter the user's weight W (illustrated as reference numeral 232). The client-side location application 28 may then determine the user's mass m (illustrated as reference numeral 234) using W=mg, where g is the acceleration due to gravity. The amount of work 230 expended during the movement may thus be expressed as $$\text{Work} = \int_{x_1}^{x_2} \left(\frac{W}{g}\right) a dx.$$

Simplifications can be made. If the acceleration a is relatively constant in value over time, the integral simplifies to the expression $$\text{Work} = \left(\frac{W}{g}\right)D,$$

where D is the distance traversed during the movement. Exemplary embodiments may thus compute the amount of work 230 expended by the user as the user's device 20 traverses the distance D (illustrated as reference numeral 40). In some circumstances, then, the amount of work 230 expended during the user's movement may be a better indicator of athletic performance.

The Doppler effect may also be used to determine when the user is walking/jogging. Suppose, for example, that the user's device 20 is attached to the user's belt or waist, while the transponder 220 is attached to the user's shoes, legs, or arms. When the user walks, runs, or swims, the user's arms or legs swing, thus putting the transponder 220 in relative motion compared to the user's device 20. When the user's device 20 receives the return signal 224, the client-side location application 28 detects a shift in frequency. The frequency shift of the received return signal 224 may be used to infer that the user is exercising. Conversely, if the client-side location application 28 determines that a distance is being traversed, but there is no Doppler frequency shift, then the transponder is not in relative motion. The client-side location application 28 may infer that the user is engaged in transportation. The Doppler effect is well-known to those of ordinary skill in the art and, therefore, will not be further explained. If the reader desires a further explanation, the reader is invited to consult David K. Cheng, Field and Wave Electromagnetics, which is incorporated herein by reference.

Exemplary embodiments may also analyze the power of the return signal 224. The power of the return signal 224 may be used to differentiate athletic movement from transportation. As those of ordinary skill in the art understand, the power of the return signal 224 diminishes as the return signal 224 propagates toward the user's device 20. As the user's arms and/or legs swing during exercise, the distance changes between the transponder 220 and the user's device 20. The changes in distance cause changes in the power of the received return signal 224. When the user's device 20 receives the return signal 224, the client-side location application 28 measures the average or instantaneous power transmitted in the return signal 224. When the power changes over time, the client-side location application 28 may infer that the user is exercising. Conversely, if the client-side location application 28 determines that the power of the return signal 224 is relatively constant, then the transponder is not in motion and the client-side location application 28 may infer that the user is engaged in transportation. The Poynting vector, Poynting's theorem, and power density are well-known calculations of the power transmitted by an electromagnetic wave. These calculations are fully explained in Field and Wave Electromagnetics (referenced above).

The power of the return signal 224 may be compared. Because electromagnetic signals convey electromagnetic power, the power within the return signal 224 may be measured or calculated and then compared to a threshold power value. While the threshold power value may be configured as desired, the threshold power value may be the average power or the instantaneous power within the return signal 224. The threshold power value may alternatively be a rate of change of power within the return signal 224. However the threshold power value is configured, the power within the return signal 224 is compared to the threshold power value. When the electromagnetic power within the return signal 224 exceeds (or is equal to) the threshold value, then the electromagnetic power may indicate that the user's legs or arms are moving, thus changing the power of the return signal 224 transmitted from the transponder 220. The client-side location application 28 may thus infer that the user is exercising. Conversely, if the electromagnetic power within the return signal 224 is less than (or equal to) the threshold value, then the transponder may not be in motion and the client-side location application 28 may infer that the user is engaged in transportation.

Figure 10:
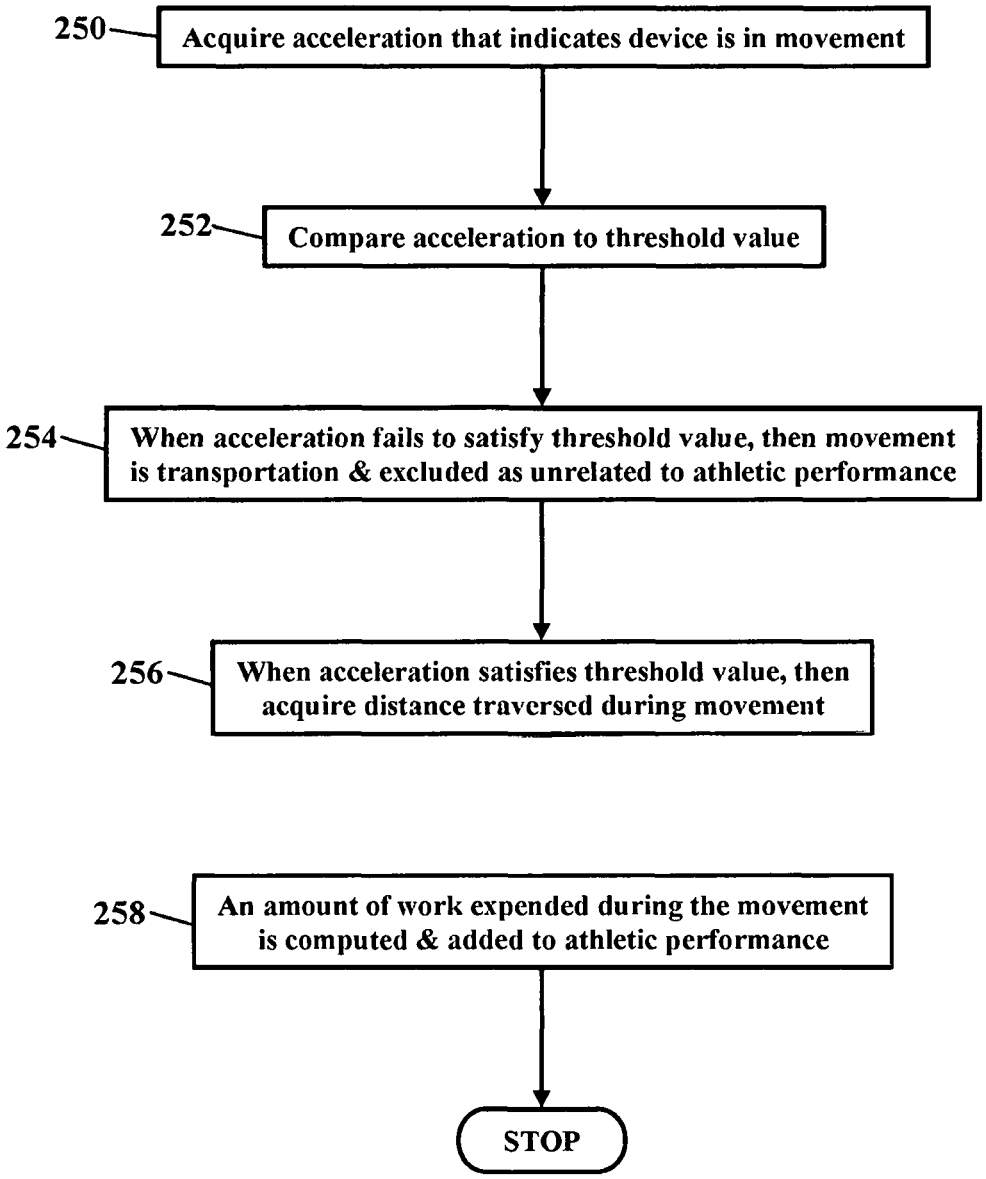
FIG. 10 is a flowchart illustrating yet another method of monitoring athletic performance, according to even more exemplary embodiments.

FIG. 10 is a flowchart illustrating yet another method of monitoring athletic performance, according to even more exemplary embodiments. An acceleration is acquired that indicates a device is in movement (Block 250). The acceleration is compared to a threshold value (Block 252). When the acceleration fails to satisfy the threshold value, then the movement is transportation and excluded as unrelated to the athletic performance (Block 254). When the acceleration satisfies the threshold value, then a distance traversed during the movement is acquired (Block 256). An amount of work expended during the movement is computed and added to the athletic performance (Block 258).

Exemplary embodiments may be physically embodied on or in a computer-readable medium. This computer-readable medium may include CD-ROM, DVD, tape, cassette, floppy disk, memory card, and large-capacity disk (such as IOMEGA®, ZIP®, JAZZ®, and other large-capacity memory products (IOMEGA®, ZIP®, and JAZZ® are registered trademarks of Iomega Corporation, 1821 W. Iomega Way, Roy, Utah 84067, 801.332.1000, www.iomega.com). This computer-readable medium, or media, could be distributed to end-subscribers, licensees, and assignees. These types of computer-readable media, and other types not mentioned here, are considered within the scope of the exemplary embodiments. A computer program product comprises processor-executable instructions for accessing common functions.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

The invention claimed is:

1. A device comprising a processor; and a memory device, the memory device storing code, the code when executed causing the processor to perform operations, the operations comprising:

receiving a signal wirelessly transmitted by a transponder, wherein the signal represents an acceleration associated with the transponder, determining that the acceleration associated with the transponder indicates that the device is moving, detecting changes in the acceleration associated with the transponder, determining whether movement of the device is associated with athletic movement or with transportation movement based on the changes in the acceleration associated with the transponder, and in response to determining that the movement of the device is associated with athletic movement, adding a distance traversed during the acceleration to a cumulative distance associated with the device.

2. The device of claim 1, wherein the device and the transponder are attachable to a body of a user.

3. The device of claim 1, wherein the operations further comprise in response to determining that the movement of the device is associated with transportation movement, excluding the distance traversed during the acceleration from the cumulative distance associated with the device.

4. The device of claim 1, wherein the signal wirelessly transmitted from the transponder is transmitted in response to an electromagnetic field emitted by the device.

5. The device of claim 1, wherein the transponder comprises an accelerometer.

6. A memory device storing instructions that, when executed by a processor of a device, cause the processor to perform operations comprising:

receiving a signal wirelessly transmitted by a transponder, wherein the signal represents an acceleration associated with the transponder;

determining that the acceleration associated with the transponder indicates that the device is moving;

detecting changes in the acceleration associated with the transponder;

determining whether movement of the device is associated with athletic movement or with transportation movement based on the changes in the acceleration associated with the transponder; and in response to determining that the movement of the device is associated with athletic movement, adding a distance traversed during the acceleration to a cumulative distance associated with the device.

7. The memory device of claim 6, wherein the device and the transponder are attachable to a body of a user.

8. The memory device of claim 6, wherein the operations further comprise in response to determining that the movement of the device is associated with transportation movement, excluding the distance traversed during the acceleration from the cumulative distance associated with the device.

9. The memory device of claim 6, wherein the signal wirelessly transmitted from the transponder is transmitted in response to an electromagnetic field emitted by the device.

10. The memory device of claim 6, wherein the transponder comprises an accelerometer.

11. A method comprising:

receiving, by a device comprising a processor, a signal wirelessly transmitted by a transponder, wherein the signal represents an acceleration associated with the transponder;

determining, by the device, that the acceleration associated with the transponder indicates that the device is moving;

detecting, by the device, changes in the acceleration associated with the transponder;

determining, by the device, whether movement of the device is associated with athletic movement or with transportation movement based on the changes in the acceleration associated with the transponder; and in response to determining that the movement of the device is associated with athletic movement, adding, by the device, a distance traversed during the acceleration to a cumulative distance associated with the device.

12. The method of claim 11, wherein the device and the transponder are attachable to a body of a user.

13. The method of claim 11, further comprising in response to determining that the movement of the device is associated with transportation movement, excluding the distance traversed during the acceleration from the cumulative distance associated with the device.

14. The method of claim 11, wherein the signal wirelessly transmitted from the transponder is transmitted in response to an electromagnetic field emitted by the device.

15. The method of claim 11, wherein the transponder comprises an accelerometer.

* * * * *